US007553044B2

(12) United States Patent
Wedell

(10) Patent No.: US 7,553,044 B2
(45) Date of Patent: Jun. 30, 2009

(54) LIGHT EMITTING DIODE SIGNALING DEVICE AND METHOD OF PROVIDING AN INDICATION USING THE SAME

(75) Inventor: Mark T. Wedell, Wilmington, NC (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 0 days.

(21) Appl. No.: 11/440,593

(22) Filed: May 25, 2006

(65) Prior Publication Data

US 2007/0274070 A1 Nov. 29, 2007

(51) Int. Cl.
*F21V 7/00* (2006.01)

(52) U.S. Cl. ..... 362/247; 362/244; 362/276; 362/240; 362/241; 362/245

(58) Field of Classification Search ..... 362/247, 362/244, 276
See application file for complete search history.

(56) References Cited

U.S. PATENT DOCUMENTS

| | | | | |
|---|---|---|---|---|
| 1,525,841 | A | 2/1925 | Wells et al. | |
| 1,548,984 | A | 8/1925 | Day | |
| 1,785,694 | A | 12/1930 | Day | |
| 4,654,629 | A | 3/1987 | Bezos et al. | |
| 4,700,278 | A | 10/1987 | Chew | |
| 4,972,302 | A * | 11/1990 | Masuyama et al. | 362/521 |
| 5,128,848 | A * | 7/1992 | Enders et al. | 362/268 |
| 5,697,584 | A | 12/1997 | Chew | |
| 5,735,492 | A | 4/1998 | Pace | |
| 5,947,587 | A | 9/1999 | Keuper et al. | |
| 6,019,493 | A | 2/2000 | Kuo et al. | |
| 6,283,613 | B1 * | 9/2001 | Schaffer | 362/245 |
| 6,435,459 | B1 | 8/2002 | Sanderson et al. | |
| 6,509,840 | B2 | 1/2003 | Martineau | |
| 6,616,299 | B2 | 9/2003 | Martineau | |
| 6,642,666 | B1 | 11/2003 | St. Germain | |
| 6,667,623 | B2 | 12/2003 | Bourgault et al. | |
| 6,717,526 | B2 | 4/2004 | Martineau et al. | |
| 6,731,222 | B2 | 5/2004 | Martineau | |
| 6,851,833 | B1 * | 2/2005 | Simon | 362/268 |
| 6,905,227 | B2 | 6/2005 | Wu | |
| 6,955,449 | B2 * | 10/2005 | Martineau | 362/246 |
| 2002/0181232 | A1 * | 12/2002 | Martineau | 362/246 |
| 2004/0252520 | A1 | 12/2004 | Martineau et al. | |

* cited by examiner

*Primary Examiner*—Ali Alavi
*Assistant Examiner*—Evan Dzierzynski
(74) *Attorney, Agent, or Firm*—Eckert Seamans Cherin & Merlott, LLC; Philip E. Levy, Esq.

(57) ABSTRACT

An improved LED signaling device employing a number of LEDs arranged in a specific pattern. At least some of the LEDs are received in a corresponding reflective cavity with an associated output angle. The LED signaling device also employs first and second lenses. The first lens collects the light emitted by the LEDs and disperses the light such that the second lens is flooded. The second lens collects the light dispersed by the first lens and collimates the light. The type of LEDs used, their specific pattern, the specific output angles of their corresponding reflective cavities, and the combination of the first and second lenses insure that the LED signaling device meets or exceeds the minimum luminous output intensity requirements and uniformity requirements.

24 Claims, 19 Drawing Sheets

| | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 15 | 40 | 75 | 150 | 250 | 375 | 400 | 375 | 250 | 150 | 75 | 40 | 15 |
| 5° D | 15 | 40 | 75 | 150 | 250 | 325 | 350 | 325 | 250 | 150 | 75 | 40 | 15 |
| 10° D | 15 | 35 | 60 | 85 | 110 | 125 | 130 | 125 | 110 | 85 | 60 | 35 | 15 |
| 15° D | 15 | 20 | 25 | 30 | 35 | 40 | 45 | 40 | 35 | 30 | 25 | 20 | 15 |
| 20° D | 10 | 15 | 15 | 15 | 15 | 15 | 15 | 15 | 15 | 15 | 15 | 15 | 10 |

*Fig. 6*

| 6" | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 49.50 | 90.74 | 202.94 | 227.69 | 348.13 | 549.42 | 843.10 | 615.41 | 313.48 | 257.38 | 191.39 | 70.95 | 57.75 |
| 5° D | 72.60 | 69.30 | 113.84 | 257.38 | 419.08 | 516.42 | 722.66 | 600.56 | 387.73 | 265.63 | 158.39 | 61.05 | 87.44 |
| 10° D | 70.95 | 79.20 | 117.14 | 145.19 | 235.94 | 194.69 | 164.99 | 189.74 | 247.49 | 145.19 | 102.29 | 92.39 | 97.34 |
| 15° D | 59.40 | 80.85 | 127.04 | 90.74 | 158.39 | 148.49 | 67.65 | 161.69 | 164.99 | 87.44 | 118.79 | 89.09 | 51.15 |
| 20° D | 28.05 | 84.15 | 130.34 | 122.09 | 148.49 | 207.89 | 254.09 | 199.64 | 138.59 | 115.49 | 161.69 | 74.25 | 29.70 |

*Fig. 7a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 3.2998 | 2.2686 | 2.7058 | 1.5179 | 1.3925 | 1.4651 | 2.1078 | 1.6411 | 1.2539 | 1.7159 | 2.5519 | 1.7736 | 3.8498 |
| 5° D | 4.8397 | 1.7324 | 1.5179 | 1.7159 | 1.6763 | 1.589 | 2.0647 | 1.8479 | 1.5509 | 1.7709 | 2.1119 | 1.5262 | 5.8297 |
| 10° D | 4.7297 | 2.2627 | 1.9524 | 1.7081 | 2.1449 | 1.5575 | 1.2692 | 1.5179 | 2.2499 | 1.7081 | 1.7049 | 2.6398 | 6.4896 |
| 15° D | 3.9598 | 4.0423 | 5.0817 | 3.0248 | 4.5254 | 3.7123 | 1.5032 | 4.0423 | 4.714 | 2.9148 | 4.7517 | 4.4547 | 3.4098 |
| 20° D | 2.8048 | 5.6097 | 8.6895 | 8.1395 | 9.8994 | 13.859 | 16.939 | 13.309 | 9.2395 | 7.6995 | 10.779 | 4.9497 | 2.9698 |

*Fig. 7b*

| 8" | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 108.07 | 79.20 | 149.32 | 201.29 | 298.63 | 640.99 | 1060.89 | 680.59 | 311.01 | 192.21 | 145.19 | 81.67 | 85.79 |
| 5° D | 70.12 | 92.39 | 155.09 | 155.09 | 265.63 | 603.86 | 1021.29 | 589.02 | 295.33 | 164.99 | 162.52 | 77.55 | 94.04 |
| 10° D | 65.17 | 80.02 | 148.49 | 136.94 | 165.82 | 157.57 | 189.74 | 169.12 | 132.82 | 138.59 | 152.62 | 92.39 | 71.77 |
| 15° D | 45.37 | 110.54 | 117.97 | 144.37 | 210.36 | 141.07 | 149.32 | 164.99 | 155.92 | 143.54 | 119.62 | 86.62 | 55.27 |
| 20° D | 22.27 | 59.40 | 113.84 | 103.94 | 150.14 | 154.27 | 168.29 | 156.74 | 158.39 | 111.37 | 134.47 | 68.47 | 23.92 |

*Fig. 8a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 7.2046 | 1.9799 | 1.9909 | 1.3419 | 1.1945 | 1.7093 | 2.6522 | 1.8149 | 1.244 | 1.2814 | 1.9359 | 2.0418 | 5.7197 |
| 5° D | 4.6747 | 2.3099 | 2.0679 | 1.0339 | 1.0625 | 1.858 | 2.918 | 1.8124 | 1.1813 | 1.0999 | 2.1669 | 1.9386 | 6.2696 |
| 10° D | 4.3447 | 2.2863 | 2.4749 | 1.6111 | 1.5074 | 1.2605 | 1.4595 | 1.3529 | 1.2074 | 1.6305 | 2.5436 | 2.6398 | 4.7847 |
| 15° D | 3.0248 | 5.5272 | 4.7187 | 4.8122 | 6.0104 | 3.5267 | 3.3181 | 4.1248 | 4.4547 | 4.7847 | 4.7847 | 4.331 | 3.6848 |
| 20° D | 2.2274 | 3.9598 | 7.5896 | 6.9296 | 10.009 | 10.284 | 11.219 | 10.449 | 10.559 | 7.4246 | 8.9645 | 4.5647 | 2.3924 |

*Fig. 8b*

| 12" | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 74.25 | 83.82 | 90.74 | 251.45 | 342.05 | 490.92 | 1022.12 | 480.20 | 288.55 | 249.63 | 88.43 | 77.38 | 66.66 |
| 5° D | 69.96 | 73.42 | 96.19 | 264.81 | 491.15 | 717.86 | 842.13 | 732.86 | 394.55 | 260.35 | 97.67 | 81.84 | 71.28 |
| 10° D | 78.21 | 73.92 | 81.84 | 101.96 | 130.84 | 259.86 | 423.20 | 201.62 | 126.71 | 104.93 | 85.96 | 78.70 | 82.00 |
| 15° D | 77.22 | 81.67 | 86.29 | 90.91 | 101.63 | 110.87 | 103.12 | 116.98 | 103.28 | 93.22 | 90.41 | 75.40 | 74.58 |
| 20° D | 39.27 | 66.00 | 75.24 | 89.26 | 97.67 | 112.03 | 103.94 | 99.16 | 104.11 | 86.29 | 77.38 | 55.93 | 35.80 |

*Fig. 9a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 4.95 | 2.1 | 1.21 | 1.68 | 1.37 | 1.31 | 2.56 | 1.28 | 1.15 | 1.66 | 1.18 | 1.93 | 4.44 |
| 5° D | 4.66 | 1.84 | 1.28 | 1.77 | 1.96 | 2.21 | 2.41 | 2.25 | 1.58 | 1.74 | 1.3 | 2.05 | 4.75 |
| 10° D | 5.21 | 2.11 | 1.36 | 1.2 | 1.19 | 2.08 | 3.26 | 1.61 | 1.15 | 1.23 | 1.43 | 2.25 | 5.47 |
| 15° D | 5.15 | 4.08 | 3.45 | 3.03 | 2.9 | 2.77 | 2.29 | 2.92 | 2.95 | 3.11 | 3.62 | 3.77 | 4.97 |
| 20° D | 3.93 | 4.4 | 5.02 | 5.95 | 6.51 | 7.47 | 6.93 | 6.61 | 6.94 | 5.75 | 5.16 | 3.73 | 3.58 |

*Fig. 9b*

| 6" - Red | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 61.29 | 73.71 | 124.46 | 199.52 | 275.11 | 463.32 | 609.64 | 461.07 | 273.49 | 202.22 | 123.38 | 67.77 | 49.68 |
| 5° D | 61.02 | 79.92 | 138.50 | 196.01 | 299.65 | 366.35 | 551.37 | 379.85 | 282.94 | 196.01 | 143.09 | 78.84 | 55.89 |
| 10° D | 44.82 | 63.18 | 119.06 | 177.11 | 234.89 | 281.34 | 245.42 | 280.24 | 234.35 | 175.76 | 122.57 | 63.18 | 49.14 |
| 15° D | 27.27 | 54.54 | 90.71 | 127.97 | 194.93 | 250.01 | 238.13 | 228.14 | 175.76 | 127.16 | 82.35 | 50.76 | 29.43 |
| 20° D | 12.69 | 41.04 | 68.85 | 98.81 | 116.63 | 125.00 | 162.80 | 129.59 | 106.91 | 98.81 | 68.04 | 45.90 | 12.69 |

*Fig. 11a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 4.0858 | 1.8426 | 1.6595 | 1.3301 | 1.1005 | 1.2355 | 1.5241 | 1.2295 | 1.094 | 1.3481 | 1.6451 | 1.6942 | 3.3118 |
| 5° D | 4.0678 | 1.9979 | 1.8467 | 1.3067 | 1.1986 | 1.1272 | 1.5753 | 1.1688 | 1.1318 | 1.3067 | 1.9079 | 1.9709 | 3.7258 |
| 10° D | 2.9878 | 1.805 | 1.9844 | 2.0836 | 2.1353 | 2.2507 | 1.8878 | 2.2419 | 2.1304 | 2.0678 | 2.0429 | 1.805 | 3.2758 |
| 15° D | 1.8179 | 2.7268 | 3.6286 | 4.2657 | 5.5694 | 6.2501 | 5.2917 | 5.7034 | 5.0217 | 4.2388 | 3.2938 | 2.5379 | 1.9619 |
| 20° D | 1.2689 | 2.7358 | 4.5897 | 6.5876 | 7.7755 | 8.3335 | 10.853 | 8.6395 | 7.1276 | 6.5876 | 4.5357 | 3.0598 | 1.2689 |

*Fig. 11b*

| 6" - Yellow | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 51.03 | 71.28 | 137.96 | 204.11 | 264.04 | 453.57 | 618.86 | 464.82 | 278.89 | 204.92 | 116.36 | 54.54 | 50.76 |
| 5° D | 59.94 | 71.82 | 154.70 | 188.72 | 301.54 | 376.18 | 532.39 | 345.95 | 298.89 | 184.13 | 139.31 | 63.99 | 58.32 |
| 10° D | 32.94 | 64.26 | 105.56 | 199.25 | 258.10 | 278.89 | 239.75 | 287.25 | 228.14 | 174.14 | 110.69 | 48.87 | 41.04 |
| 15° D | 26.46 | 44.55 | 84.24 | 136.88 | 203.84 | 251.63 | 261.88 | 237.05 | 202.76 | 128.78 | 79.92 | 51.03 | 25.65 |
| 20° D | 17.82 | 39.42 | 47.25 | 86.12 | 106.10 | 140.66 | 154.16 | 131.48 | 103.94 | 71.55 | 56.16 | 31.32 | 12.96 |

*Fig. 12a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 3.4018 | 1.7819 | 1.8395 | 1.3607 | 1.0562 | 1.2095 | 1.5472 | 1.2395 | 1.1156 | 1.3661 | 1.5515 | 1.3634 | 3.3838 |
| 5° D | 3.9958 | 1.7954 | 2.0627 | 1.2581 | 1.2062 | 1.1575 | 1.5211 | 1.0645 | 1.1955 | 1.2275 | 1.8575 | 1.5997 | 3.8878 |
| 10° D | 2.1959 | 1.8359 | 1.7594 | 2.3441 | 2.3464 | 2.2311 | 1.8442 | 2.298 | 2.074 | 2.0487 | 1.8449 | 1.3962 | 2.7358 |
| 15° D | 1.7639 | 2.2274 | 3.3694 | 4.5627 | 5.8239 | 6.2906 | 5.8197 | 5.9262 | 5.7931 | 4.2927 | 3.1966 | 2.5514 | 1.7099 |
| 20° D | 1.7819 | 2.6278 | 3.1498 | 5.7417 | 7.0736 | 9.3774 | 10.277 | 8.7655 | 6.9296 | 4.7697 | 3.7438 | 2.0879 | 1.2959 |

*Fig. 12b*

| 6" - Green | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 76.83 | 108.41 | 203.18 | 312.37 | 398.60 | 654.79 | 919.97 | 679.01 | 382.18 | 391.75 | 158.72 | 90.08 | 72.93 |
| 5° D | 82.29 | 102.17 | 217.61 | 298.74 | 434.00 | 535.77 | 768.63 | 551.74 | 408.28 | 281.95 | 195.77 | 102.95 | 72.93 |
| 10° D | 74.10 | 93.59 | 176.27 | 277.66 | 362.60 | 394.70 | 335.08 | 425.00 | 320.61 | 253.49 | 167.69 | 86.57 | 65.13 |
| 15° D | 46.80 | 92.03 | 145.46 | 205.91 | 302.98 | 370.85 | 357.13 | 343.25 | 287.01 | 180.17 | 131.03 | 80.73 | 39.78 |
| 20° D | 22.62 | 70.20 | 100.61 | 138.05 | 173.15 | 204.74 | 249.98 | 201.62 | 167.30 | 132.20 | 109.97 | 55.77 | 12.48 |

*Fig. 13a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 5.1217 | 2.7103 | 2.709 | 2.0825 | 1.5944 | 1.7461 | 2.2999 | 1.8107 | 1.5287 | 1.945 | 2.1163 | 2.2521 | 4.8617 |
| 5° D | 5.4857 | 2.5544 | 2.9014 | 1.9916 | 1.736 | 1.6485 | 2.1961 | 1.6977 | 1.6331 | 1.8797 | 2.6102 | 2.5738 | 4.8617 |
| 10° D | 4.9397 | 2.6741 | 2.9378 | 3.2666 | 3.2964 | 3.1576 | 2.5775 | 3.4 | 2.9146 | 2.9822 | 2.78948 | 2.4736 | 4.3417 |
| 15° D | 3.1198 | 4.6017 | 5.8185 | 6.8636 | 8.6566 | 9.2713 | 7.9362 | 8.5814 | 8.2002 | 6.0056 | 5.2413 | 4.0363 | 2.6518 |
| 20° D | 2.2619 | 4.6797 | 6.7076 | 9.2035 | 11.543 | 13.649 | 16.665 | 13.441 | 11.153 | 8.8135 | 7.3316 | 3.7178 | 1.2479 |

*Fig. 13b*

| 6" - White | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 77.40 | 83.88 | 199.79 | 283.29 | 359.00 | 627.04 | 862.90 | 623.51 | 337.63 | 263.86 | 166.67 | 84.96 | 72.00 |
| 5° D | 78.48 | 108.71 | 180.35 | 246.23 | 386.98 | 514.47 | 753.48 | 485.22 | 384.13 | 251.99 | 184.67 | 89.99 | 62.64 |
| 10° D | 64.44 | 78.84 | 146.87 | 237.23 | 348.13 | 363.50 | 302.43 | 374.75 | 285.46 | 244.07 | 140.75 | 87.11 | 57.60 |
| 15° D | 39.24 | 80.28 | 134.63 | 181.07 | 264.22 | 333.66 | 333.36 | 328.33 | 260.26 | 180.71 | 107.99 | 75.96 | 37.08 |
| 20° D | 19.08 | 57.60 | 93.59 | 142.55 | 144.71 | 181.43 | 222.83 | 172.79 | 158.39 | 125.63 | 97.91 | 42.12 | 14.04 |

*Fig. 14a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 5.1597 | 2.0969 | 2.6638 | 1.8886 | 1.436 | 1.6721 | 2.1572 | 1.6627 | 1.3505 | 1.7591 | 2.2223 | 2.1239 | 4.7997 |
| 5° D | 5.2317 | 2.7178 | 2.4047 | 1.6415 | 1.5479 | 1.583 | 2.1528 | 1.493 | 1.5365 | 1.6799 | 2.4623 | 2.2499 | 4.1758 |
| 10° D | 4.2957 | 2.2524 | 2.4479 | 2.7909 | 3.1648 | 2.908 | 2.3264 | 2.998 | 2.5951 | 2.8714 | 2.3459 | 2.489 | 3.8398 |
| 15° D | 2.6158 | 4.0138 | 5.3853 | 6.0356 | 7.5493 | 8.3414 | 7.4079 | 8.2083 | 7.4361 | 6.0236 | 4.3197 | 3.7978 | 2.4719 |
| 20° D | 1.9079 | 3.8398 | 6.2396 | 9.5034 | 9.6474 | 12.095 | 14.855 | 11.519 | 10.559 | 8.3755 | 6.5276 | 2.8078 | 1.4039 |

*Fig. 14b*

| 8" - Red | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 81.18 | 88.10 | 177.20 | 239.24 | 325.45 | 571.92 | 742.08 | 582.79 | 334.33 | 256.39 | 168.29 | 76.56 | 66.64 |
| 5° D | 71.28 | 91.73 | 177.86 | 245.84 | 354.35 | 450.12 | 684.71 | 469.17 | 352.48 | 220.43 | 192.05 | 72.60 | 71.28 |
| 10° D | 67.71 | 71.94 | 141.56 | 217.79 | 277.18 | 344.45 | 297.63 | 352.70 | 285.10 | 227.36 | 140.57 | 83.49 | 65.01 |
| 15° D | 48.84 | 77.55 | 127.04 | 150.14 | 240.23 | 291.37 | 320.76 | 291.37 | 224.72 | 146.51 | 112.52 | 87.11 | 46.86 |
| 20° D | 19.14 | 51.48 | 104.93 | 106.58 | 132.32 | 166.97 | 194.36 | 167.30 | 129.02 | 112.85 | 112.19 | 45.21 | 19.14 |

*Fig. 16a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 5.41 | 2.20 | 2.36 | 1.59 | 1.30 | 1.53 | 1.86 | 1.55 | 1.34 | 1.71 | 2.24 | 1.91 | 4.58 |
| 5° D | 4.75 | 2.29 | 2.37 | 1.64 | 1.42 | 1.38 | 1.96 | 1.44 | 1.14 | 1.47 | 2.56 | 1.81 | 4.75 |
| 10° D | 4.11 | 2.06 | 2.36 | 2.56 | 2.52 | 2.76 | 2.29 | 2.82 | 2.59 | 2.67 | 2.34 | 2.39 | 4.33 |
| 15° D | 3.26 | 3.88 | 5.08 | 5.00 | 6.86 | 7.28 | 7.13 | 7.28 | 6.42 | 4.88 | 4.50 | 4.36 | 3.12 |
| 20° D | 1.91 | 3.43 | 7.00 | 7.11 | 8.82 | 11.13 | 12.96 | 11.15 | 8.60 | 7.52 | 7.48 | 3.01 | 1.91 |

*Fig. 16b*

| 8" - Yellow | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 54.00 | 69.93 | 149.03 | 196.28 | 281.59 | 461.07 | 635.51 | 464.15 | 259.45 | 192.77 | 137.96 | 67.77 | 60.48 |
| 5° D | 55.08 | 72.90 | 146.87 | 192.23 | 287.80 | 373.10 | 560.22 | 356.60 | 297.27 | 183.05 | 143.36 | 75.33 | 54.27 |
| 10° D | 54.81 | 62.64 | 112.85 | 192.77 | 248.39 | 269.68 | 253.25 | 289.47 | 237.05 | 162.53 | 117.98 | 64.53 | 48.60 |
| 15° D | 37.26 | 74.79 | 107.72 | 129.59 | 188.18 | 260.26 | 261.88 | 237.59 | 187.10 | 129.32 | 102.86 | 75.60 | 34.29 |
| 20° D | 17.01 | 49.41 | 86.12 | 89.36 | 112.58 | 138.50 | 166.85 | 134.18 | 112.04 | 88.28 | 98.00 | 44.28 | 12.69 |

*Fig. 17a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 3.60 | 1.75 | 1.99 | 1.31 | 1.13 | 1.23 | 1.59 | 1.24 | 1.04 | 1.29 | 1.84 | 1.69 | 4.03 |
| 5° D | 3.67 | 1.82 | 1.96 | 1.28 | 1.15 | 1.15 | 1.60 | 1.10 | 1.19 | 1.22 | 1.91 | 1.88 | 3.62 |
| 10° D | 3.65 | 1.79 | 1.88 | 2.27 | 2.26 | 2.16 | 1.95 | 2.32 | 2.15 | 1.91 | 1.97 | 1.84 | 3.24 |
| 15° D | 2.48 | 3.74 | 4.31 | 4.32 | 5.38 | 6.51 | 5.82 | 5.94 | 5.35 | 4.31 | 4.11 | 3.78 | 2.29 |
| 20° D | 1.70 | 3.29 | 5.74 | 5.96 | 7.51 | 9.23 | 11.12 | 8.95 | 7.47 | 5.89 | 6.53 | 2.95 | 1.27 |

*Fig. 17b*

| 8" - Green | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 85.40 | 95.54 | 225.02 | 286.21 | 407.60 | 677.44 | 892.97 | 665.36 | 373.55 | 280.75 | 200.45 | 113.09 | 77.22 |
| 5° D | 78.00 | 111.14 | 217.22 | 291.31 | 398.90 | 529.99 | 775.75 | 530.74 | 403.33 | 267.91 | 193.43 | 95.15 | 83.07 |
| 10° D | 79.56 | 109.58 | 169.25 | 284.71 | 347.83 | 404.45 | 338.91 | 445.70 | 328.71 | 264.79 | 171.98 | 97.88 | 77.61 |
| 15° D | 56.94 | 97.10 | 143.51 | 205.52 | 300.64 | 332.98 | 361.93 | 350.23 | 274.15 | 186.02 | 138.05 | 89.30 | 47.58 |
| 20° D | 24.57 | 70.20 | 140.00 | 141.17 | 155.21 | 231.65 | 248.42 | 203.18 | 157.55 | 124.79 | 130.64 | 63.57 | 14.82 |

*Fig. 18a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 5.69 | 2.39 | 3.00 | 1.91 | 1.63 | 1.81 | 2.23 | 1.77 | 1.49 | 1.87 | 2.67 | 2.83 | 5.15 |
| 5° D | 5.20 | 2.78 | 2.90 | 1.94 | 1.60 | 1.63 | 2.22 | 1.63 | 1.61 | 1.79 | 2.58 | 2.38 | 5.54 |
| 10° D | 5.30 | 3.13 | 2.82 | 3.35 | 3.16 | 3.24 | 2.61 | 3.57 | 2.99 | 3.12 | 2.87 | 2.80 | 5.17 |
| 15° D | 3.80 | 4.86 | 5.74 | 6.85 | 8.59 | 8.32 | 8.04 | 8.76 | 7.83 | 6.20 | 5.52 | 4.47 | 3.17 |
| 20° D | 2.46 | 4.68 | 9.33 | 9.41 | 10.35 | 15.44 | 16.56 | 13.55 | 10.50 | 8.32 | 8.71 | 4.24 | 1.48 |

*Fig. 18b*

| 8" - White | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 84.60 | 86.75 | 199.43 | 284.02 | 386.68 | 631.39 | 829.83 | 640.39 | 347.75 | 277.90 | 173.87 | 82.80 | 78.12 |
| 5° D | 86.75 | 94.67 | 209.51 | 251.99 | 382.63 | 506.82 | 725.36 | 479.15 | 402.73 | 236.87 | 188.99 | 89.99 | 75.96 |
| 10° D | 72.36 | 95.03 | 160.55 | 254.15 | 316.78 | 388.78 | 303.07 | 385.15 | 301.66 | 239.39 | 156.23 | 76.68 | 64.80 |
| 15° D | 51.84 | 90.35 | 136.07 | 168.11 | 260.62 | 321.51 | 337.56 | 335.61 | 264.58 | 167.03 | 122.39 | 91.07 | 39.60 |
| 20° D | 18.00 | 59.04 | 122.03 | 141.83 | 166.31 | 197.27 | 225.71 | 175.67 | 154.07 | 126.35 | 136.07 | 46.08 | 14.76 |

*Fig. 19a*

| % of spec | -30 | -25 | -20 | -15 | -10 | -5 | 0 | 5 | 10 | 15 | 20 | 25 | 30 |
|---|---|---|---|---|---|---|---|---|---|---|---|---|---|
| 0° | 5.64 | 2.17 | 2.66 | 1.89 | 1.55 | 1.68 | 2.07 | 1.71 | 1.39 | 1.85 | 2.32 | 2.07 | 5.21 |
| 5° D | 5.78 | 2.37 | 2.79 | 1.68 | 1.53 | 1.56 | 2.07 | 1.47 | 1.61 | 1.58 | 2.52 | 2.25 | 5.06 |
| 10° D | 4.82 | 2.72 | 2.68 | 2.99 | 2.88 | 3.11 | 2.33 | 3.08 | 2.74 | 2.82 | 2.60 | 2.19 | 4.32 |
| 15° D | 3.46 | 4.52 | 5.44 | 5.60 | 7.45 | 8.04 | 7.50 | 8.39 | 7.56 | 5.57 | 4.90 | 4.55 | 2.64 |
| 20° D | 1.80 | 3.94 | 8.14 | 9.46 | 11.09 | 13.15 | 15.05 | 11.71 | 10.27 | 8.42 | 9.07 | 3.07 | 1.48 |

*Fig. 19b*

LIGHT EMITTING DIODE SIGNALING DEVICE AND METHOD OF PROVIDING AN INDICATION USING THE SAME

BACKGROUND OF THE INVENTION

1. Field of the Invention

The present invention relates generally to signaling devices and more particularly to an improved light emitting diode signaling device and a method of providing an indication using the same.

2. Background Information

Light emitting diodes (LEDs) are replacing incandescent bulbs in various types of signaling devices such as, for example and without limitation, traffic signals, railroad crossing signals, and railroad wayside signals. An LED signaling device (i.e., a signaling device incorporating LEDs as an indication source) consumes less power, provides increased reliability, and requires less maintenance than a comparable incandescent signaling device (i.e., a signaling device incorporating an incandescent bulb as an indication source).

Older generation LEDs used in LED signaling devices, however, have several limitations. For example, the luminous output intensity of individual older generation LEDs is fairly low. As a result, dozens and sometimes hundreds of LEDs must be employed to generate the minimum luminous output intensity for certain signaling devices. The use of large numbers of LEDs, however, increases the manufacturing, operating, and maintenance costs of the LED signaling device. Additionally, the amount of space needed to accommodate the large number of LEDs make retrofitting some existing incandescent signaling devices prohibitive.

LED technology has continued to improve. For instance, newer generation LEDs are capable of generating a higher luminous output with lower power consumption than older generation LEDs. Thus when employed in a signaling device, fewer new generation LEDs are needed to meet the minimum luminous output intensity requirements for the signaling device. The use of fewer LEDs, however, may cause uniformity problems. Specifically, the use of fewer LEDs may undesirably increase the potential for viewing one or more of the LEDs as an individual point source and/or may undesirably increase the potential of creating shadows. A typical uniformity requirement may demand that the ratio between the greatest luminance LED and least luminance LED in the signaling device must not exceed 5:1 when measured over average areas of 500 mm.

Thus, a need exists for an improved LED signaling device which employs fewer LEDs, which meets or exceeds minimum luminous output intensity requirements, and which meets or exceeds minimum uniformity requirements. A method of providing an indication using the improved LED signaling device is also needed.

SUMMARY OF THE INVENTION

These needs and others are met by the present invention, which is directed to an improved LED signaling device. The improved LED signaling device employs a number of LEDs arranged in a specific pattern. At least some of the LEDs are received in a corresponding reflective cavity with an associated output angle. The LED signaling device also employs first and second lenses. The first lens collects the light emitted by the LEDs and disperses the light such that the second lens is flooded. The second lens collects the light dispersed by the first lens and collimates the light. The type of LEDs used, their specific pattern, the specific output angles of their corresponding reflective cavities, and the combination of the first and second lenses insure that the LED signaling device meets or exceeds the minimum luminous output intensity requirements and uniformity requirements.

As another aspect of the invention, an improved LED signaling device comprises a back plate, a circuit board, a reflector, a first lens, and a second lens. The circuit board is coupled to the back plate. The circuit board has a first surface with a number of LEDs arranged in a pattern thereon. The reflector is coupled to at least one of the back plate and the circuit board and has a number of reflective cavities, each with an associated output angle. At least some of the reflective cavities are arranged in the pattern and are structured to receive at least one of the LEDs therein. The first lens is coupled to at least one of the back plate, the circuit board, and the reflector and is located a first distance from the first surface. The second lens is coupled to at least one of the back plate, the circuit board, the reflector, and the first lens, and is located a second distance from the first surface.

As another aspect of the invention, a method for providing an indication with an LED signaling device comprises activating a number of LEDs to produce a plurality of light rays, wherein the LEDs are arranged in a pattern, and wherein each of at least some of the LEDs are associated with a respective one of a plurality of reflective cavities each having an associated output angle, dispersing the light rays with a first lens, and collimating the light rays dispersed by the first lens with a second lens.

BRIEF DESCRIPTION OF THE DRAWINGS

A full understanding of the invention can be gained from the following description of the preferred embodiments when read in conjunction with the accompanying drawings in which:

FIG. 6 is a table illustrating the minimum luminous output intensity requirements for a railroad wayside signaling device.

FIG. 7*a* is a specification table illustrating the luminous output intensity for a 6" LED signaling device employing the LED pattern shown in FIG. 4.

FIG. 7*b* is a table illustrating the percentage of the minimum luminous output intensity requirement for the specification table of FIG. 7*a*.

FIG. 8*a* is a specification table illustrating the luminous output intensity for an 8" LED signaling device employing the LED pattern shown in FIG. 4.

FIG. 8*b* is a table illustrating the percentage of the minimum luminous output intensity requirement for the specification table of FIG. 8*a*.

FIG. 9*a* is a specification table illustrating the luminous output intensity for a 12" LED signaling device employing the LED pattern shown in FIG. 5.

FIG. 9*b* is a table illustrating the percentage of the minimum luminous output intensity requirement for the specification table of FIG. 9*a*.

FIG. 11*a* is a specification table illustrating the luminous output intensity for a 6" LED signaling device employing the LED pattern shown in FIG. 10 with red LEDs.

FIG. 11*b* is a table illustrating the percentage of the minimum luminous output intensity requirement for the specification table of FIG. 11*a*.

FIG. 12*a* is a specification table illustrating the luminous output intensity for a 6" LED signaling device employing the LED pattern shown in FIG. 10 with yellow LEDs.

FIG. 12*b* is a table illustrating the percentage of the minimum luminous output intensity requirement for the specification table of FIG. 12*a*.

FIG. 13*a* is a specification table illustrating the luminous output intensity for a 6" LED signaling device employing the LED pattern shown in FIG. 10 with green LEDs.

FIG. 13*b* is a table illustrating the percentage of the minimum luminous output intensity requirement for the specification table of FIG. 13*a*.

FIG. 14*a* is a specification table illustrating the luminous output intensity for a 6" LED signaling device employing the LED pattern shown in FIG. 10 with white LEDs.

FIG. 14*b* is a table illustrating the percentage of the minimum luminous output intensity requirement for the specification table of FIG. 14*a*.

FIG. 16*a* is a specification table illustrating the luminous output intensity for an 8" LED signaling device employing the LED pattern shown in FIG. 15 with red LEDs.

FIG. 16*b* is a table illustrating the percentage of the minimum luminous output intensity requirement for the specification table of FIG. 16*a*.

FIG. 17*a* is a specification table illustrating the luminous output intensity for an 8" LED signaling device employing the LED pattern shown in FIG. 15 with yellow LEDs.

FIG. 17*b* is a table illustrating the percentage of the minimum luminous output intensity requirement for the specification table of FIG. 17*a*.

FIG. 18*a* is a specification table illustrating the luminous output intensity for an 8" LED signaling device employing the LED pattern shown in FIG. 15 with green LEDs.

FIG. 18*b* is a table illustrating the percentage of the minimum luminous output intensity requirement for the specification table of FIG. 18*a*.

FIG. 19*a* is a specification table illustrating the luminous output intensity for an 8" LED signaling device employing the LED pattern shown in FIG. 15 with white LEDs.

FIG. 19*b* is a table illustrating the percentage of the minimum luminous output intensity requirement for the specification table of FIG. 19*a*.

DESCRIPTION OF THE PREFERRED EMBODIMENTS

Figure 1:
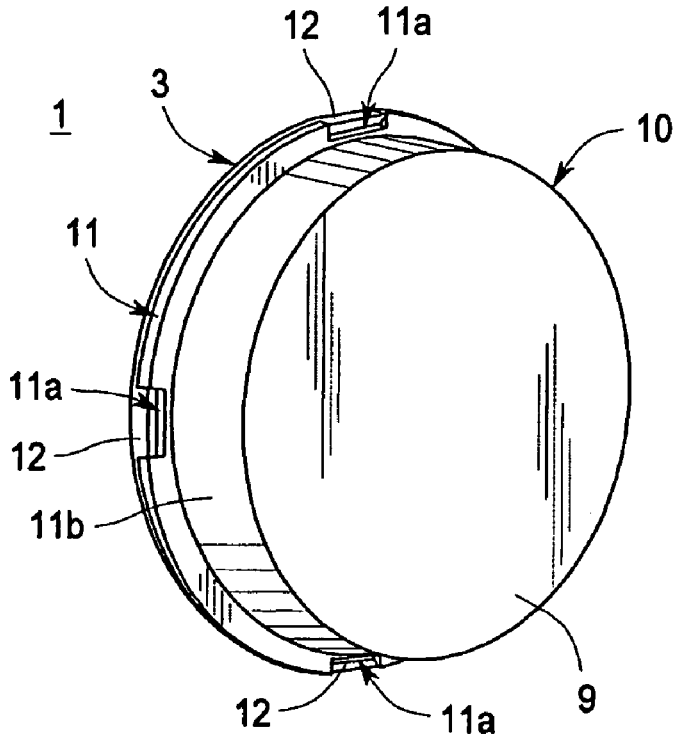
FIG. 1 is an isometric view of an LED signaling device according to one embodiment.

Directional phrases used herein, such as, for example, left, right, clockwise, counterclockwise, top, bottom, up, down, and derivatives thereof, relate to the orientation of the elements shown in the drawings and are not limiting upon the claims unless expressly recited therein.

As employed herein, the term "number" shall mean one or more than one and the singular form of "a", "an", and "the" include plural referents unless the context clearly indicates otherwise.

As employed herein, the statement that two or more parts are "connected" or "coupled" together shall mean that the parts are joined together either directly or joined together through one or more intermediate parts. Further, as employed herein, the statement that two or more parts are "attached" shall mean that the parts are joined together directly.

Figure 3:
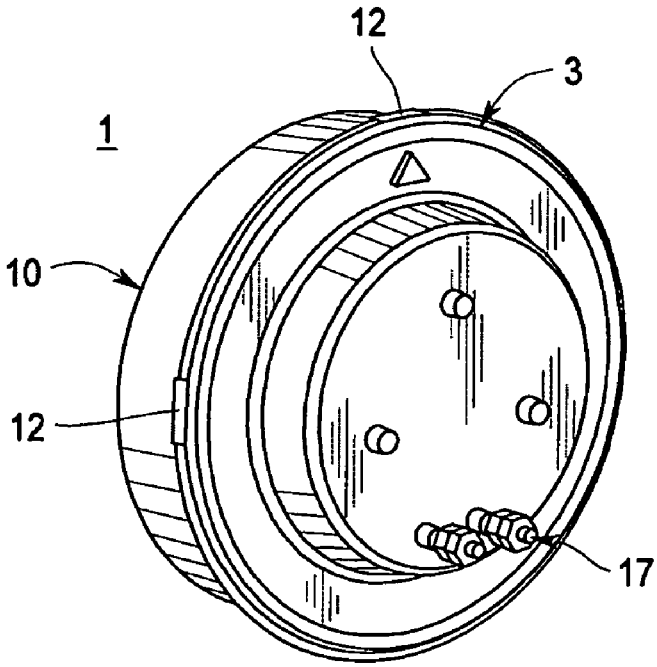
FIG. 3 is an isometric view of the back of the LED signaling device of FIG. 1.
Figure 2:
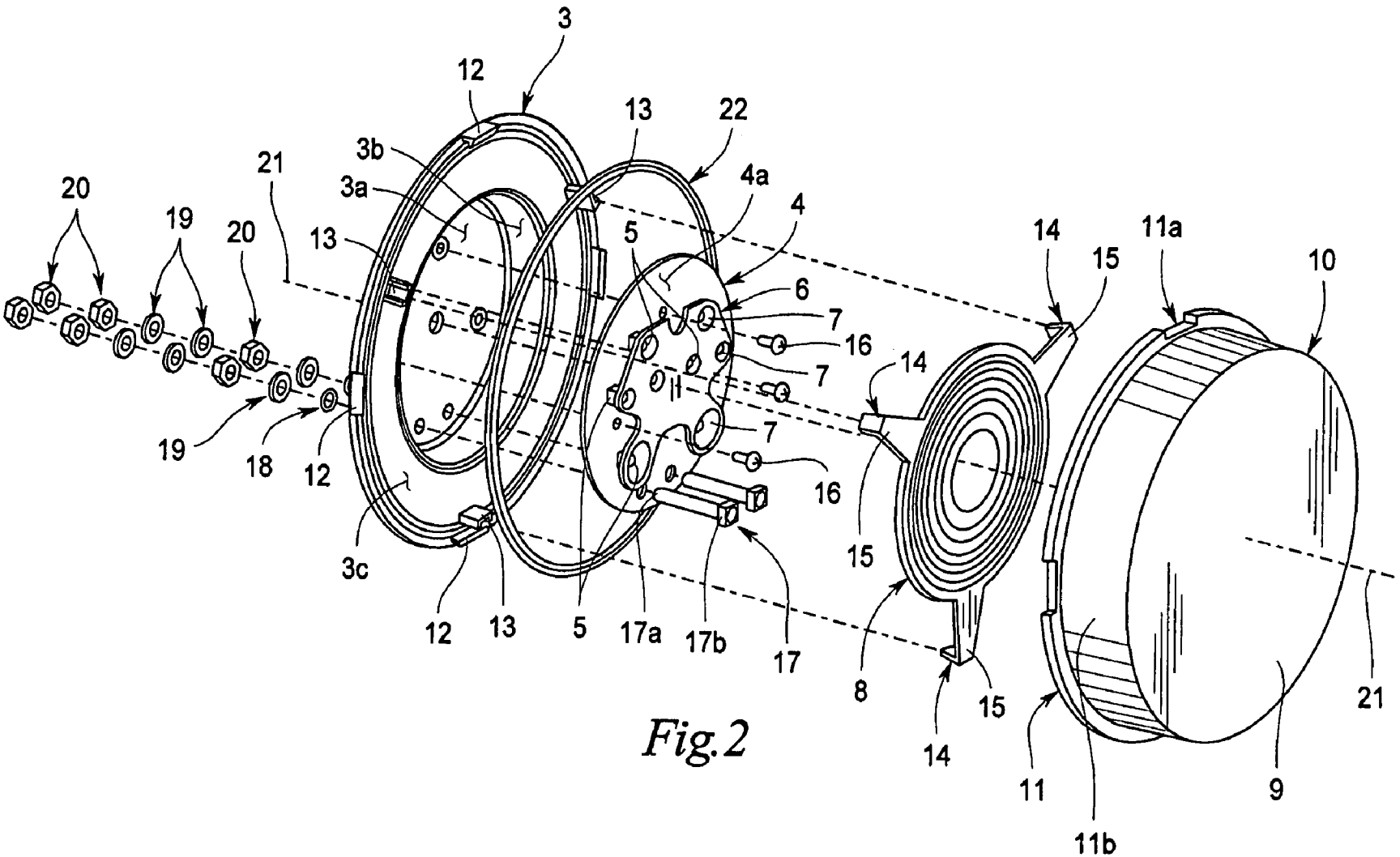
FIG. 2 is an exploded view of the LED signaling device of FIG. 1.

Referring to FIGS. 1-3, an LED signaling device 1 is illustrated according to one embodiment. The LED signaling device 1 comprises a back plate 3, a circuit board 4, a reflector 6, a first fresnel lens 8, and a second fresnel lens 9.

In the current embodiment, the back plate 3 includes a rear wall 3*a* that is generally circular in shape. A side wall 3*b* extends axially from the outer circumference of the rear wall 3*a* and a flange 3*c* extends radial from the opposite end of the side wall 3*b*. The flange 3*c* includes a number of slotted posts 13 spaced about an inner circumference and a number of clips 12 spaced about an outer circumference. In the current embodiment, the back plate 3 is constructed of injection molded nylon having a spun aluminum heat sink molded therein. The heat sink may be molded into one, or a combination of, the rear wall 3*a*, the side wall 3*b*, and the flange 3*c*. It should be noted that other materials and or arrangements may be utilized for the back plate 3 and/or heat sink while remaining within the scope of the present invention.

In the current embodiment, the circuit board 4 is coupled to the rear wall 3*a* of back plate 3, for example, using a number of screws 16 or other fasteners. The circuit board 4 has a surface 4*a* with a number of LEDs 5 arranged in a pattern thereon. For example in the current embodiment, eight LEDs 5 are arranged in a pattern relative to a central axis 21 running through the LED signaling device 1. Although other LEDs 5 may be used, the LEDs 5 used in the current embodiment are red LUXEON® K2 high-powered LEDs manufactured by Lumileds Lighting (e.g., part number LXK2-PD12-S00). These LEDs 5 are rated to produce approximately 55 lumens at approximately 350 mA. The circuit board 4 includes at least one electrical terminal structured to receive an electrical signal for powering the LEDs 5. For instance in the current embodiment, an external conductor (not shown) for supplying a signal may be connected to a first end 17*a* of a stud 17 which passes through the rear wall 3*a* of base plate 3. The external conductor may be secured to the first end 17*a* of the stud 17 via a combination of washers 19 and nuts 20. An O-ring 18 may be included to prevent moisture, etc. from entering the LED signal device. A second end 17*b* of the stud 17 is electrically connected to the circuit board 4.

The reflector 6 is coupled to at least one of the back plate 3 and, as illustrated in FIG. 2, the circuit board 4. The reflector 6 includes a number of reflective cavities 7. Each reflective cavity 7 is generally conical in shape and is structured to receive one of the LEDs 5 (or a portion of the LED 5) therein. In the current embodiment, LEDs 5 are received at the vertex of the conical shaped reflective cavities 7. Each reflective cavity 7 has an output angle associated therewith. The term "output angle" generally refers to an angle made by a cross section through the vertex and the center of the opening. The reflective cavities 7 are structured to reflect, in a particular direction and/or pattern, the light emitted by their associated LEDs 5. As illustrated in FIG. 2, the reflective cavities 7 are arranged in a pattern that is substantially the same as the pattern of the LEDs 5. Accordingly, each LED 5 is associated with a reflective cavity 7. It should be noted, however, that one or more of LEDs 5 may not have a reflective cavity 7 associated therewith while still remaining within the scope of the present invention.

The first fresnel lens 8 is coupled to at least one of the back plate 3, the circuit board 4, and the reflector 6. In the current embodiment, the first fresnel lens 8 includes a number of arms 15 radially extending from the outer circumference thereof. The end of each arm 15 includes a tab 14 which is structured to engage a corresponding slot in one of the slotted posts 13 on the base plate 3. When the LED signaling device 1 is assembled, the first fresnel lens 8 is located a distance from the surface 4*a* of the circuit board 4. In the current embodiment for example, the first fresnel lens 8 is located approximately 28.5 mm from surface 4*a*. Although the first lens 8 is discussed as being a fresnel lens, it is contemplated that another type of lens may be used while remaining within the scope of the present invention.

The second fresnel lens 9 is coupled to at least one of the back plate 3, the circuit board 4, the reflector 6, and the first fresnel lens 8. In the current embodiment, the second fresnel lens 9 is incorporated into a cover 10. The cover 10 includes a base ring 11 having a number of notches 11*a* therein. The second fresnel lens 9 is spaced apart from the base ring 11 by a side wall 11*b*. The notches 11*a* are structured to engage corresponding clips 12 located on the back plate 3. Cover 10 is structured to form a "snap-fit" with base plate 3 when the notches 11*a* are engaged with their corresponding clips 12. One or more O-rings 22 may be provided to promote a proper seal such that water, dirt, and other debris cannot enter into the LED signaling device 1. When the LED signaling device 1 is assembled, the second fresnel lens 9 is located a distance from the surface 4*a* of the circuit board 4. In the current embodiment for example, the second fresnel lens 9 is located approximately 60 mm from surface 4*a*. Although the second lens 9 is discussed as being a fresnel lens, it is contemplated that another type of lens may be used while remaining within the scope of the present invention.

In the current embodiment, the LEDs 5, the LED pattern, the reflective cavities 7, and the dual lenses cooperate such that the LED signaling device 1 meets or exceeds minimum luminous output intensity requirements and uniformity requirements. More specifically, the pattern of the LEDs, the output angles of the reflective cavities 7, and the location of the first fresnel lens 8 relative to the surface 4*a* of the circuit board 4, are chosen such that substantially the entire surface of the first fresnel lens 8 is illuminated by the light emitted by the LEDs 5. The first fresnel lens 8 collects the light emitted by the LEDs 5 and disperses the light. The design of the first fresnel lens 8 and the location of the second fresnel lens 9 relative to the surface 4*a* (and thus, the distance between the first and second fresnel lens) is chosen such that the entire surface of the second fresnel lens 9 is flooded. The second fresnel lens 9 collects the light dispersed by the first fresnel lens 8 and collimates the light.

By dispersing the light emitted by the LEDs with the first fresnel lens 8 such that the second fresnel lens 9 is flooded, the uniformity requirements are met (i.e., the potential for viewing one or more of the LEDs 5 as an individual point source and/or the potential of creating undesirable shadows is eliminated). For example, the ratio between the greatest luminous LED and least luminous LED in the signaling device does not exceed 5:1 when measured over average areas of 500 mm. Additionally, by collimating the light with the second fresnel lens 9, the light is "focused" such that the minimum luminous output intensity requirements are met (as will be discussed in more detail in conjunction with FIGS. 6-9*b*).

Figure 4:
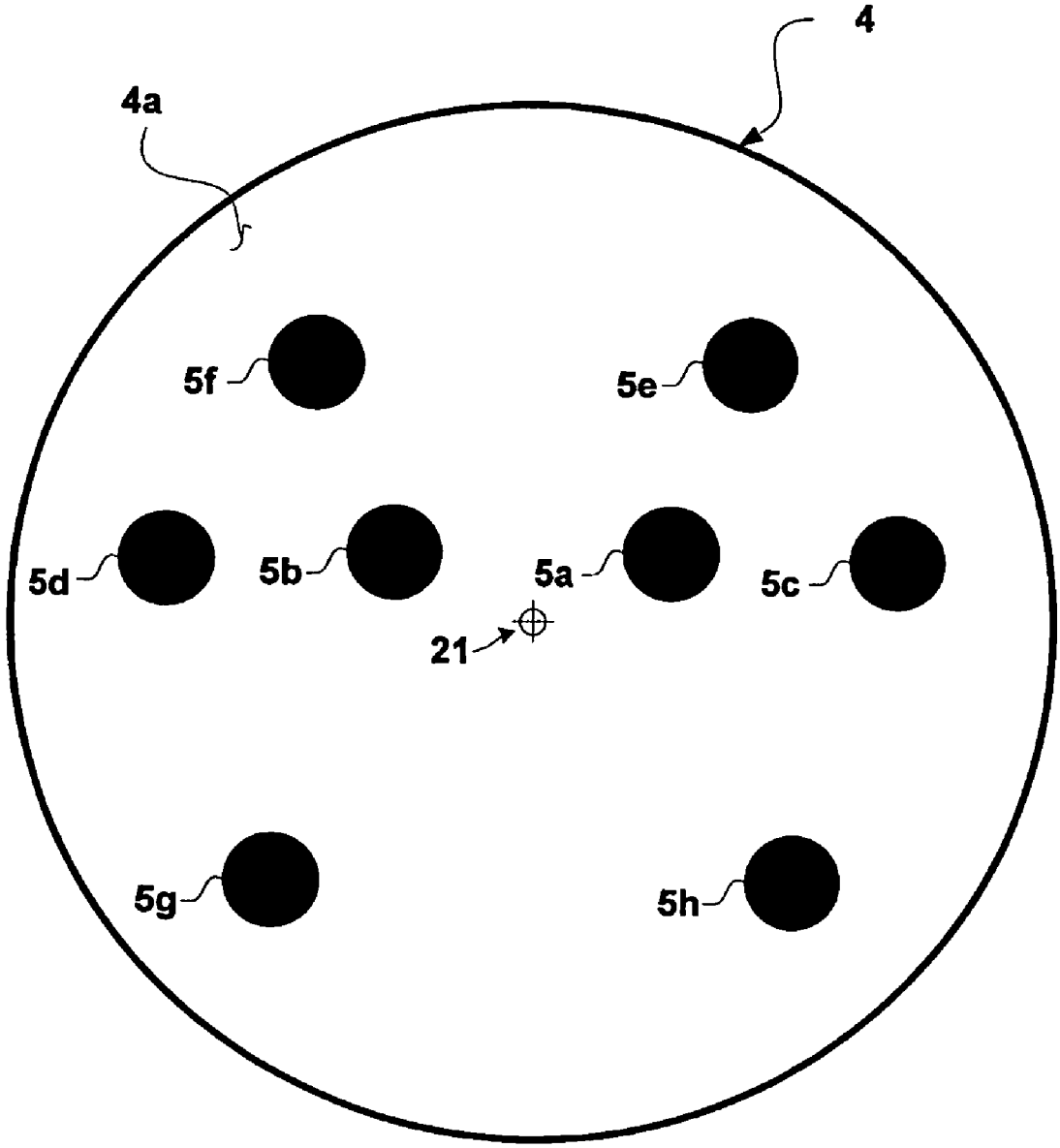
FIG. 4 is a simplified view of the LED pattern for the LED signaling device of FIG. 1 according to one embodiment.

FIG. 4 is a detailed illustration of a pattern of LEDs 5 for the LED signaling device 1 of FIG. 1. In the discussion of FIG. 4, the pattern is referenced relative to an "origin", which in the current embodiment refers to a point on the surface 4*a* of circuit board 4 through which central axis 21 passes.

The pattern illustrated in FIG. 4 may be used, for example, in a 6" LED signaling device. One such 6" LED signaling device employs a first fresnel lens 8 with a radius of curvature of 300 mm, a conic constant of −20, a thickness of 1.5 mm, a fresnel thickness of 0.5 mm, a pitch of 1 degree, and a diameter of 120 mm. Additionally, the 6" LED signaling device employs a second fresnel lens 9 with a radius of curvature of 150 mm, a conic constant of −12, a thickness of 1.5 mm, a fresnel thickness of 0.5 mm, a pitch of 1 degree, and a diameter of 150 mm.

The pattern illustrated in FIG. 4 may also be used, in an 8" LED signaling device. One such 8" LED signaling device employs a first fresnel lens 8 with a radius of curvature of 400 mm, a conic constant of −16, a thickness of 1.5 mm, a fresnel thickness of 0.5 mm, a pitch of 1 degree, and a diameter of 120 mm. Additionally, the 8" LED signaling device employs a second fresnel lens 9 has a radius of curvature of 100 mm, a conic constant of −12, a thickness of 1.5 mm, a fresnel thickness of 0.5 mm, a pitch of 1 degree, and a diameter of 200 mm.

Table 1 lists the x, y, and z coordinates (measured in millimeters) for each LED 5, as well as the output angle of the reflective cavity 7 associated with each LED, for the pattern illustrated in FIG. 4.

TABLE 1

LED pattern and reflective Cavity Output Angle for 6" and 8" LED signaling devices of FIG. 4.

| LED | x-coordinate | y-coordinate | z-coordinate | Reflective Cavity Output Angle |
|---|---|---|---|---|
| 5a | 16 | 8 | 0 | 12 |
| 5b | −16 | 8 | 0 | 12 |
| 5c | 42 | 7 | 0 | 15.5 |
| 5d | −42 | 7 | 0 | 15.5 |
| 5e | 25 | 30 | 0 | 30 |
| 5f | −25 | 30 | 0 | 30 |
| 5g | 30 | −30 | 0 | 50 |
| 5h | −30 | −30 | 0 | 50 |

Figure 5:
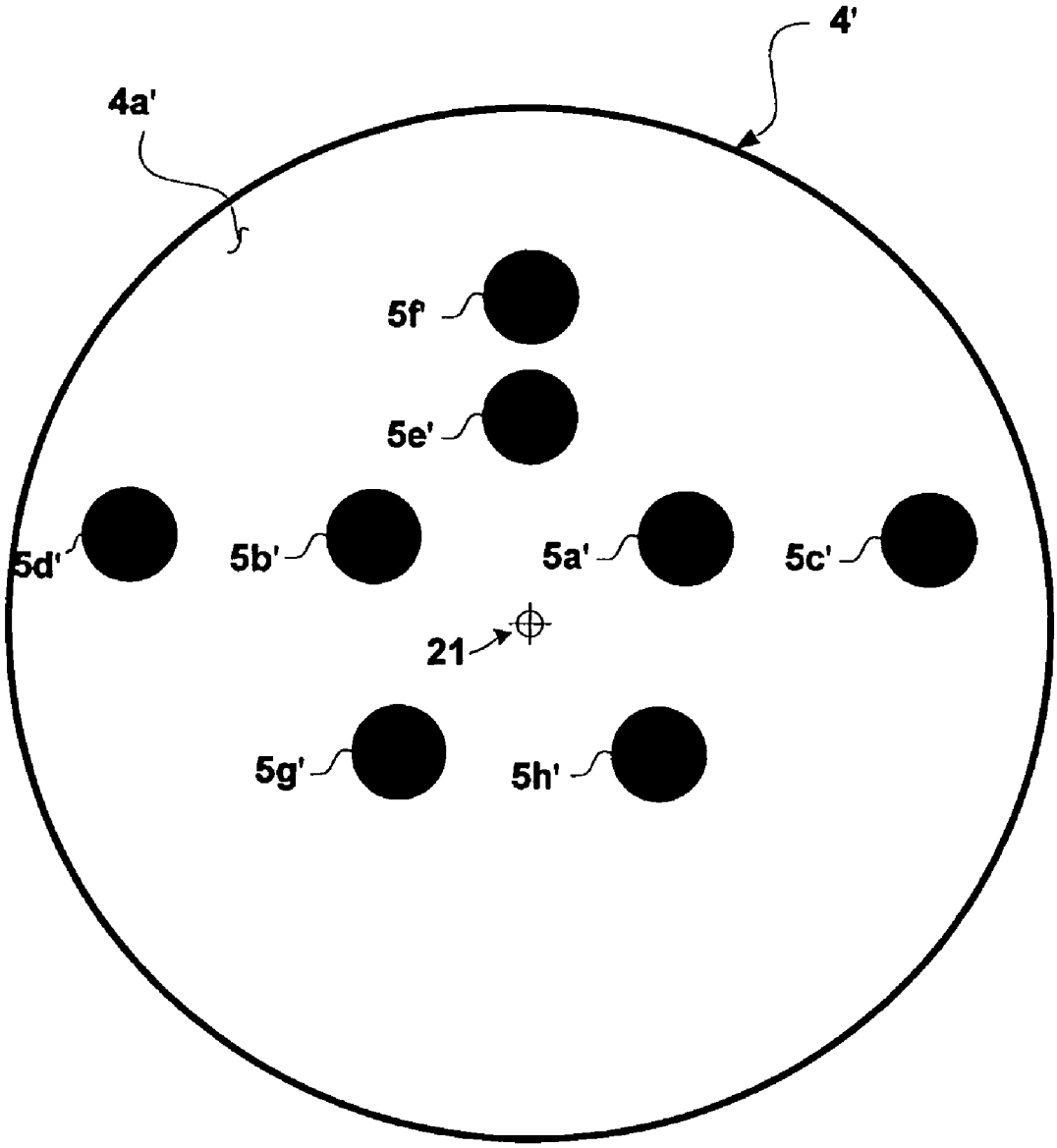
FIG. 5 is a simplified view of the LED pattern for the LED signaling device of FIG. 1 according to another embodiment.

FIG. 5 is a detailed illustration of a pattern of LEDs 5 for the LED signaling device 1 of FIG. 1 according to an alternative embodiment. Specifically, the pattern illustrated in FIG. 5 may be used in a 12" LED signaling device. Again, the pattern is referenced from an "origin", which refers to a point on the surface 4*a*' of circuit board 4' through which central axis 21 passes. One such 12" LED signaling device employs a first fresnel lens 8 with a radius of curvature of 1000 mm, a conic constant of −20, a thickness of 1.5 mm, a fresnel thickness of 0.5 mm, a pitch of 1 degree, and a diameter of 200 mm. Additionally, the 12" LED signaling device employs a second fresnel lens 9 with a radius of curvature of 100 mm, a conic constant of −12, a thickness of 1.5 mm, a fresnel thickness of 0.5 mm, a pitch of 1 degree, and a diameter of 300 mm.

Table 2 lists the x, y, and z coordinates (measured in millimeters) for each LED 5, as well as the output angle of the reflective cavity 7 associated with each LED, for the pattern illustrated in FIG. 5. As evident in Table 2, LED 5*f*, LED 5*g*, and LED 5*h* do not have an associated reflective cavity.

TABLE 2

LED pattern and reflective Cavity Output Angle for 12" LED signaling device of FIG. 5.

| LED | x-coordinate | y-coordinate | z-coordinate | Reflective Cavity Output Angle |
|---|---|---|---|---|
| 5a' | 18 | 10 | 0 | −10 |
| 5b' | −18 | 10 | 0 | −10 |
| 5c' | 46 | 10 | 0 | −5 |
| 5d' | −46 | 10 | 0 | −5 |
| 5e' | 0 | 24 | 0 | −10 |
| 5f' | 0 | 38 | 0 | No reflective cavity |
| 5g' | −15 | −15 | 0 | No reflective cavity |
| 5h' | 15 | −15 | 0 | No reflective cavity |

FIG. 6 is a table illustrating the minimum luminous output intensity (Candela) requirements for a railroad wayside signaling device over its rated lifetime and operating temperature range. For example, at a temperature of 0°, the signaling device is required to output a minimum of 15 Candela when the signaling device is viewed at 30 degrees off center (i.e., at −30 and 30 in the table). As another example, at a temperature of deviation of 10° from its normal operating temperature, the signaling device is required to output a minimum of 125 Candela when the signaling device is viewed at 5 degrees off center (i.e., at −5 and 5 in the table).

FIG. 7*a* illustrates the luminous output intensity and FIG. 7*b* illustrates the percentage of the minimum luminous output intensity requirement, respectively, for the 6" LED signaling device discussed above in conjunction with FIG. 4. Referring to FIG. 7*a* for example, at a temperature of 0°, the 6" LED signaling device outputs 49.50 Candela when the signaling device is viewed at −30 degrees relative to center which, referring to FIG. 7*b*, is 3.2998 times the minimum luminous output intensity requirement. At the same temperature, the 6" LED signaling device outputs 57.75 Candela when the signaling device is viewed at 30 degrees relative to center which, referring to FIG. 7*b*, is 3.8498 times the minimum luminous output intensity. As can be seen in FIG. 7*b*, the minimum luminous output intensity requirements are met by the 6" LED signaling device for each temperature and for each viewing angle (i.e., the values in FIG. 7*b* never fall below 1.0).

FIG. 8*a* illustrates the luminous output intensity and FIG. 8*b* illustrates the percentage of the minimum luminous output intensity requirement, respectively, for the 8" LED signaling device discussed above in conjunction with FIG. 4. As can be seen in FIG. 8*b*, the minimum luminous output intensity requirements are met by the 8" LED signaling device for each temperature and for each viewing angle (i.e., the values in FIG. 8*b* never fall below 1.0).

FIG. 9*a* illustrates the luminous output intensity and FIG. 9*b* illustrates the percentage of the minimum luminous output intensity requirement, respectively, for the 12" LED signaling device discussed above in conjunction with FIG. 5. As can be seen in FIG. 9*b*, the minimum luminous output intensity requirements are met by the 12" LED signaling device for each temperature and for each viewing angle (i.e., the values in FIG. 9*b* never fall below 1.0).

Figure 10:
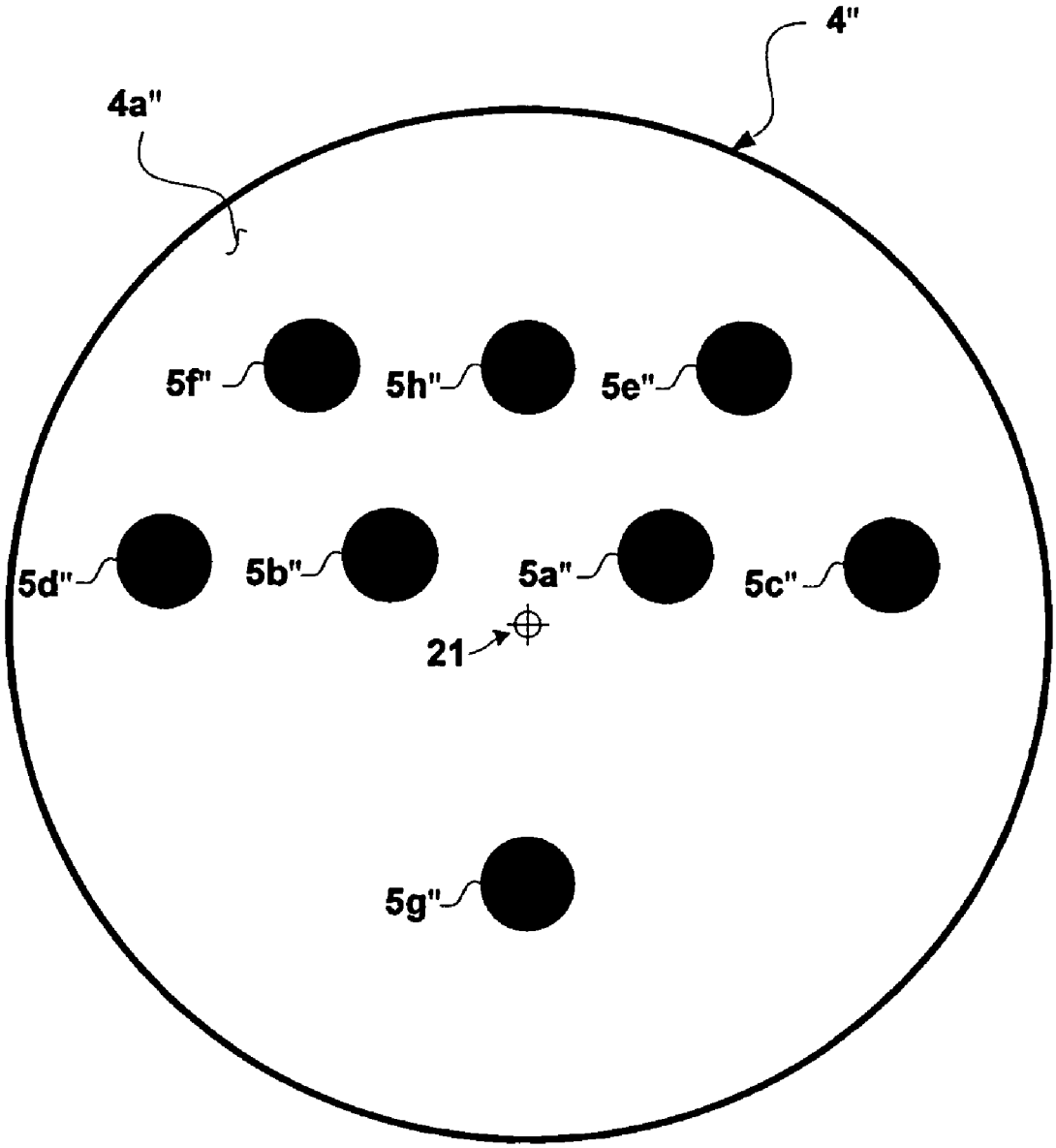
FIG. 10 is a simplified view of the LED pattern for the LED signaling device of FIG. 1 according to another embodiment.

FIG. 10 is a detailed illustration of the pattern of LEDs 5 for another embodiment of the LED signaling device 1 of FIG. 1. In the discussion of FIG. 10, the pattern is referenced relative to an "origin", which in the current embodiment refers to a point on the surface 4*a*" of circuit board 4" through which central axis 21 passes.

The pattern illustrated in FIG. 10 may be used, for example, in a 6" LED signaling device, which as discussed above in conjunction with FIG. 4, employs a first fresnel lens 8 with a radius of curvature of 300 mm, a conic constant of −20, a thickness of 1.5 mm, a fresnel thickness of 0.5 mm, a pitch of 1 degree, and a diameter of 120 mm. Additionally, the 6" LED signaling device employs a second fresnel lens 9 with a radius of curvature of 150 mm, a conic constant of −12, a thickness of 1.5 mm, a fresnel thickness of 0.5 mm, a pitch of 1 degree, and a diameter of 150 mm.

Table 3 lists the x, y, and z coordinates (measured in millimeters) for each LED 5, as well as the output angle of the reflective cavity 7 associated with each LED, for the pattern illustrated in FIG. 10.

TABLE 3

LED pattern and reflective Cavity Output Angle for 6" LED signaling device of FIG. 10.

| LED | x-coordinate | y-coordinate | z-coordinate | Reflective Cavity Output Angle |
|---|---|---|---|---|
| 5a" | 16 | 8 | 0 | 12 |
| 5b" | −16 | 8 | 0 | 12 |
| 5c" | 42 | 7 | 0 | 25 |
| 5d" | −42 | 7 | 0 | 25 |
| 5e" | 25 | 30 | 0 | 30 |
| 5f" | −25 | 30 | 0 | 30 |
| 5g" | 0 | −30 | 0 | 50 |
| 5h" | 0 | 30 | 0 | 21 |

As illustrated in FIG. 10, eight LEDs 5 are arranged in a pattern relative to a central axis 21 running through the LED signaling device 1. Although other LEDs 5 may be used, the LEDs 5 used in the current embodiment are LUXEON® K2 high-powered LEDs manufactured by Lumileds Lighting. The pattern illustrated in FIG. 10 achieves the uniformity and intensity requirements for several different colored LUXEON® K2 high-powered LEDs operating at approximately 350 mA. For example and without limitation, red LUXEON® K2 LEDs producing approximately 55 lumens (e.g., part number LXK2-PD12-S00), yellow LUXEON® K2 LEDs producing approximately 45 lumens (e.g., part number LXK2-PL12-R00), green LUXEON® K2 LEDs producing approximately 65 lumens (e.g., part number LXK2-PE12-S00), and white LUXEON® K2 LEDs producing approximately 60 lumens (e.g., part number LXK2-PW12-S00) may be employed.

FIGS. 11*a*, 12*a*, 13*a*, and 14*a* are specification tables illustrating the luminous output intensity for the LED signaling device of FIG. 10 for each of the different colored LEDs discussed above (i.e., red, yellow, green, and white). FIGS. 11*b*, 12*b*, 13*b*, and 14*b* are tables illustrating the percentage of the minimum luminous output intensity requirement for each of their associated specification table (e.g., FIG. 11*b* is a table illustrating the percentage of the minimum luminous output intensity requirement for the specification table of FIG. 11*a*). As can be seen in FIGS. 11*b*, 12*b*, 13*b*, and 14*b*, the minimum luminous output intensity requirements are met by the 6" LED signaling device for each temperature and for each viewing angle (i.e., the values in FIGS. 11*b*, 12*b*, 13*b*, and 14*b* never fall below 1.0).

Figure 15:
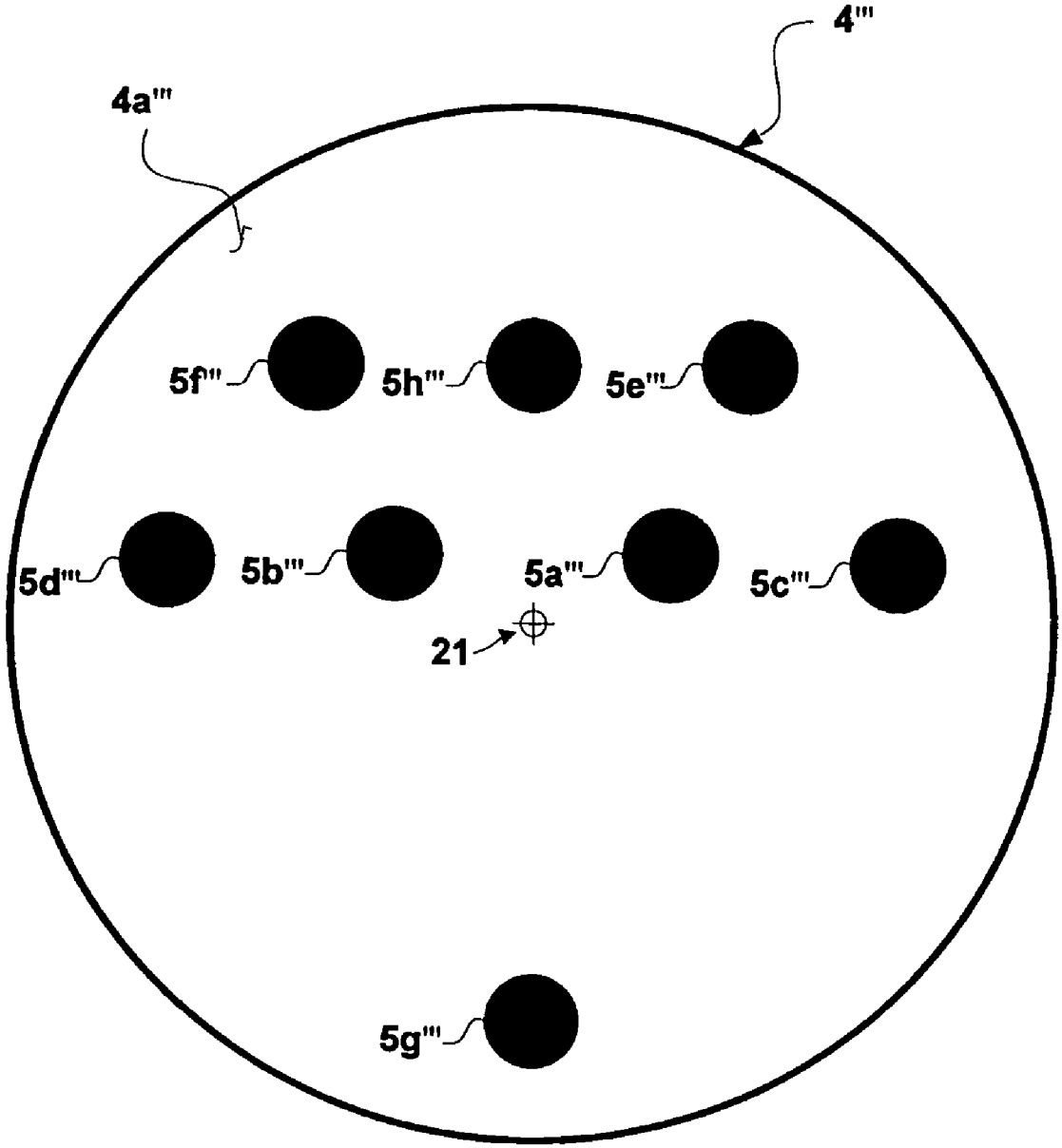
FIG. 15 is a simplified view of the LED pattern for the LED signaling device of FIG. 1 according to another embodiment.

FIG. 15 is a detailed illustration of the pattern of LEDs 5 for another embodiment of the LED signaling device 1 of FIG. 1. In the discussion of FIG. 15, the pattern is referenced relative to an "origin", which in the current embodiment refers to a point on the surface 4*a*'" of circuit board 4'" through which central axis 21 passes.

The pattern illustrated in FIG. 15 may be used, for example, in an 8" LED signaling device, which as discussed above in conjunction with FIG. 4, employs a first fresnel lens 8 with a radius of curvature of 400 mm, a conic constant of −16, a thickness of 1.5 mm, a fresnel thickness of 0.5 mm, a pitch of 1 degree, and a diameter of 120 mm. Additionally, the 8" LED signaling device employs a second fresnel lens 9 has a radius of curvature of 100 mm, a conic constant of −12, a thickness of 1.5 mm, a fresnel thickness of 0.5 mm, a pitch of 1 degree, and a diameter of 200 mm.

Table 4 lists the x, y, and z coordinates (measured in millimeters) for each LED 5, as well as the output angle of the reflective cavity 7 associated with each LED, for the pattern illustrated in FIG. 15.

TABLE 4

LED pattern and reflective Cavity Output Angle for 8" LED signaling device of FIG. 15.

| LED | x-coordinate | y-coordinate | z-coordinate | Reflective Cavity Output Angle |
|---|---|---|---|---|
| 5a''' | 16 | 8 | 0 | 12 |
| 5b''' | −16 | 8 | 0 | 12 |
| 5c''' | 42 | 7 | 0 | 25 |
| 5d''' | −42 | 7 | 0 | 25 |
| 5e''' | 25 | 30 | 0 | 30 |
| 5f''' | −25 | 30 | 0 | 30 |
| 5g''' | 0 | −45 | 0 | 50 |
| 5h''' | 0 | 30 | 0 | 21 |

As discussed above, the various colored LEDs 5 (for example and without limitation, red, yellow, green, and white LUXEON® K2 high-powered LEDs manufactured by Lumileds Lighting) may be used in the current embodiment. The pattern illustrated in FIG. 15 achieves the uniformity and intensity requirements for each of the several different colored LEDs.

FIGS. 16*a*, 17*a*, 18*a*, and 19*a* are specification tables illustrating the luminous output intensity for the LED signaling device of FIG. 15 for each of the different colored LEDs discussed above (i.e., red, yellow, green, and white). FIGS. 16*b*, 17*b*, 18*b*, and 19*b* are tables illustrating the percentage of the minimum luminous output intensity requirement for each of their associated specification table (e.g., FIG. 16*b* is a table illustrating the percentage of the minimum luminous output intensity requirement for the specification table of FIG. 16*a*). As can be seen in FIGS. 16*b*, 17*b*, 18*b*, and 19*b*, the minimum luminous output intensity requirements are met by the 8" LED signaling device for each temperature and for each viewing angle (i.e., the values in FIGS. 16*b*, 17*b*, 18*b*, and 19*b* never fall below 1.0).

Figure 20:
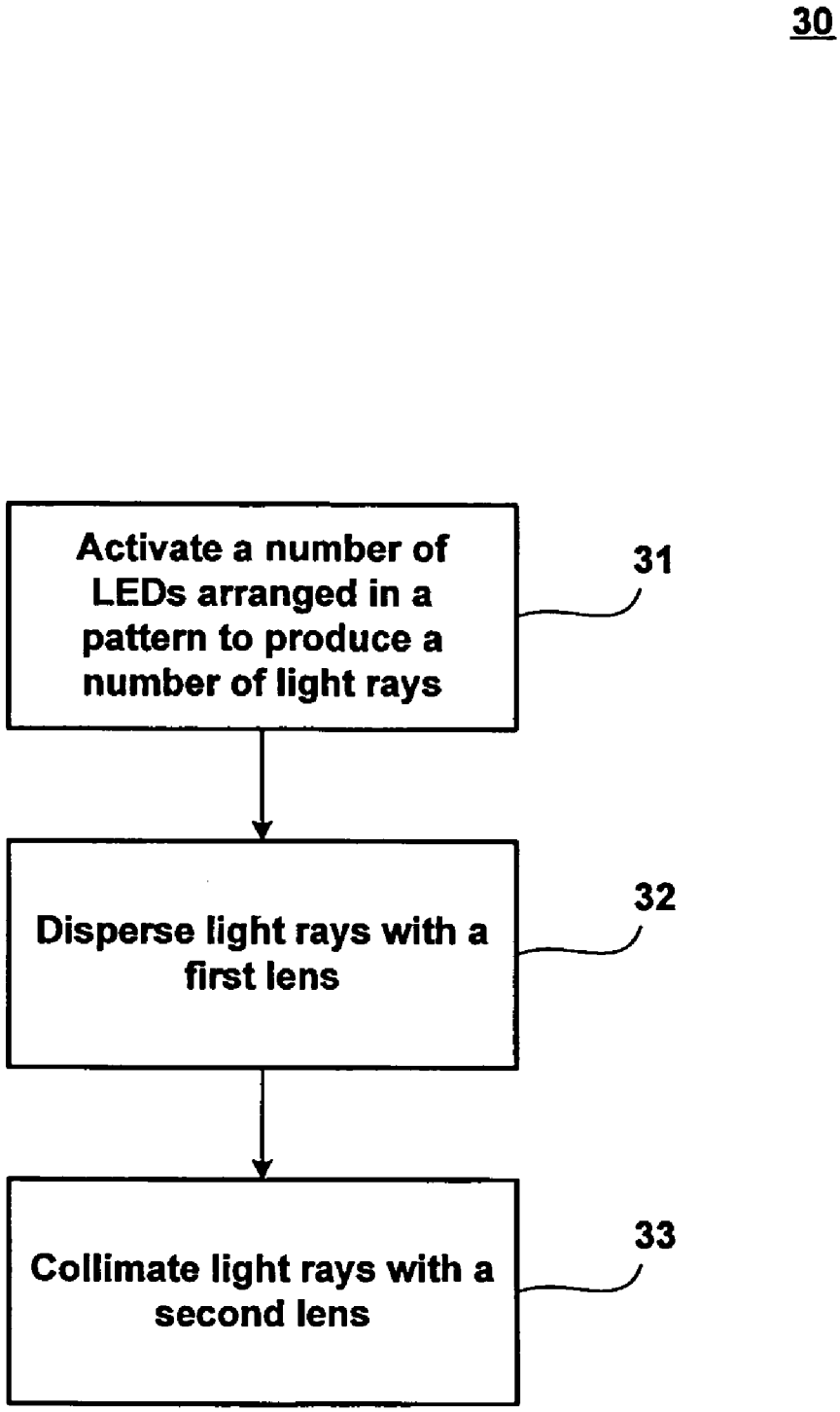
FIG. 20 illustrates an operational process for providing an indication with an LED signaling device according to one embodiment.

FIG. 20 illustrates an operational process 30 for providing an indication with an LED signaling device 1 (such as, for example and without limitation, the signaling devices discussed above in conjunction with FIGS. 4, 5, 10 and 15). Operational process 30 begins at operation 31 where a number of LEDs are activated to produce a plurality of light rays. The LEDs are arranged in a pattern, each of at least some of said LEDs are associated with a reflective cavity having an associated output angle. Operational control then passes to operation 32 where the light rays are dispersed with a first fresnel lens. Operational control then passes to operation 33 where the light rays, dispersed by the first fresnel lens, are collimated by a second fresnel lens.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An LED signaling device, comprising:

a back plate;

a circuit board coupled to said back plate, said circuit board having a first surface with a number of LEDs arranged in a pattern thereon;

a reflector coupled to at least one of said back plate and said circuit board, said reflector having a number of reflective cavities each with an associated output angle, wherein at least some of said reflective cavities are arranged in said pattern and are structured to receive at least one of said LEDs therein;

a first lens coupled to at least one of said back plate, said circuit board, and said reflector, said first lens structured to disperse light rays emitted by at least some of said LEDs, said first lens being located a first distance from said first surface; and a second lens, coupled to at least one of said back plate, said circuit board, said reflector, and said first lens, said second lens structured to receive said light rays dispersed by said first lens and to collimate said light rays dispersed by said first lens, said second lens being located a second distance from said first surface;

wherein said pattern is arranged according to an x, y, z, coordinate system relative to a central axis of said LED signaling device and wherein said pattern includes:

a first LED having an x-coordinate of about 16 mm, a y-coordinate of about 8 mm, and a z-coordinate of about 0 mm, said first LED being received within a first one of said reflective cavities with an associated output angle of about 12 degrees;

a second LED having an x-coordinate of about −16 mm, a y-coordinate of about 8 mm, and a z-coordinate of about 0 mm, said second LED being received within a second one of said reflective cavities with an associated output angle of about 12 degrees;

a third LED having an x-coordinate of about 42 mm, a y-coordinate of about 7 mm, and a z-coordinate of about 0 mm, said third LED being received within a third one of said reflective cavities with an associated output angle of about 15.5 degrees;

a fourth LED having an x-coordinate of about −42 mm, a y-coordinate of about 7 mm, and a z-coordinate of about 0 mm, said fourth LED being received within a fourth one of said reflective cavities with an associated output angle of about 15.5 degrees;

a fifth LED having an x-coordinate of about 25 mm, a y-coordinate of about 30 mm, and a z-coordinate of about 0 mm, said fifth LED being received within a fifth one of said reflective cavities with an associated output angle of about 30 degrees;

a sixth LED having an x-coordinate of about −25 mm, a y-coordinate of about 30 mm, and a z-coordinate of about 0 mm, said sixth LED being received within a sixth one of said reflective cavities with an associated output angle of about 30 degrees;

a seventh LED having an x-coordinate of about 30 mm, a y-coordinate of about −30 mm, and a z-coordinate of about 0 mm, said seventh LED being received within a seventh one of said reflective cavities with an associated output angle of about 50 degrees; and an eighth LED having an x-coordinate of about −30 mm, a y-coordinate of about −30 mm, and a z-coordinate of about 0 mm, said eighth LED being received within an eighth one of said reflective cavities with an associated output angle of about 50 degrees.

2. The LED signaling device of claim 1 wherein said first lens is a fresnel lens structured to disperse light rays emitted by at least some of said LEDs onto said second lens, and wherein said second lens is a fresnel lens structured to collimate said light rays dispersed by said first fresnel lens.

3. The LED signaling device of claim 1 wherein said first distance is about 28.5 mm, and wherein said second distance is about 60 mm.

4. The LED signaling device of claim 3 wherein said first lens is a fresnel lens having a radius of curvature of about 300 mm, a conic constant of about −20, a thickness of about 1.5 mm, a fresnel thickness of about 0.5 mm, a pitch of about 1 degree, and a diameter of about 120 mm and wherein said second lens is a fresnel lens having a radius of curvature of about 150 mm, a conic constant of about −12, a thickness of about 1.5 mm, a fresnel thickness of about 0.5 mm, a pitch of about 1 degree, and a diameter of about 150 mm.

5. The LED signaling device of claim 3 wherein said first lens is a fresnel lens having a radius of curvature of about 400 mm, a conic constant of about −16, a thickness of about 1.5 mm, a fresnel thickness of about 0.5 mm, a pitch of about 1 degree, and a diameter of about 120 mm and wherein said second lens is a fresnel lens having a radius of curvature of about 100 mm, a conic constant of about −12, a thickness of about 1.5 mm, a fresnel thickness of about 0.5 mm, a pitch of about 1 degree, and a diameter of about 200 mm.

6. The LED signaling device of claim 3 wherein said first lens is a fresnel lens having a radius of curvature of about 1000 mm, a conic constant of about −20, a thickness of about 1.5 mm, a fresnel thickness of about 0.5 mm, a pitch of about 1 degree, and a diameter of about 200 mm and wherein said second lens is a fresnel lens having a radius of curvature of about 100 mm, a conic constant of about −12, a thickness of about 1.5 mm, a fresnel thickness of about 0.5 mm, a pitch of about 1 degree, and a diameter of about 300 mm.

7. The LED signaling device of claim 1 wherein said circuit board further comprises at least one electrical terminal structured to receive an electrical signal for powering at least some of said LEDs.

8. The LED signaling device of claim 1 wherein each of said LEDs emits approximately 55 lumens at approximately 350 mA.

9. The LED signaling device of claim 1 wherein said back plate includes a heat sink structured to dissipate heat generated by said LEDs.

10. The LED signaling device of claim 1 wherein said second lens forms at least a portion of a cover structured to couple with said back plate to form a housing enclosing said circuit board, said reflector, and said first lens.

11. The LED signaling device of claim 10 wherein said cover is structured to form a snap-fit with said back plate.

12. An LED signaling device, comprising:

a back plate;

a circuit board coupled to said back plate, said circuit board having a first surface with a number of LEDs arranged in a pattern thereon;

a reflector coupled to at least one of said back plate and said circuit board, said reflector having a number of reflective cavities each with an associated output angle, wherein at least some of said reflective cavities are arranged in said pattern and are structured to receive at least one of said LEDs therein;

a first lens coupled to at least one of said back plate, said circuit board, and said reflector, said first lens structured to disperse light rays emitted by at least some of said LEDs, said first lens being located a first distance from said first surface; and a second lens, coupled to at least one of said back plate, said circuit board, said reflector, and said first lens, said second lens structured to receive said light rays dispersed by said first lens and to collimate said light rays dispersed by said first lens, said second lens being located a second distance from said first surface;

wherein said pattern is arranged according to an x, y, z coordinate system relative to a central axis of said LED signaling device and wherein said pattern includes:

a first LED having an x-coordinate of about 18 mm, a y-coordinate of about 10 mm, and a z-coordinate of about 0 mm, said first LED being received within a first one of said reflective cavities with an associated output angle of about −10 degrees;

a second LED having an x-coordinate of about −18 mm, a y-coordinate of about 10 mm, and a z-coordinate of about 0 mm, said second LED being received within a second one of said reflective cavities with an associated output angle of about −10 degrees;

a third LED having an x-coordinate of about 46 mm, a y-coordinate of about 10 mm, and a z-coordinate of about 0 mm, said third LED being received within a third one of said reflective cavities with an associated output angle of about −5 degrees;

a fourth LED having an x-coordinate of about −46 mm, a y-coordinate of about 10 mm, and a z-coordinate of about 0 mm, said fourth LED being received within a fourth one of said reflective cavities with an associated output angle of about −5 degrees;

a fifth LED having an x-coordinate of about 0 mm, a y-coordinate of about 24 mm, and a z-coordinate of about 0 mm, said fifth LED being received within a fifth one of said reflective cavities with an associated output angle of about −10 degrees;

a sixth LED having an x-coordinate of about 0 mm, a y-coordinate of about 38 mm, and a z-coordinate of about 0 mm;

a seventh LED having an x-coordinate of about −15 mm, a y-coordinate of about −15 mm, a z-coordinate of about 0 mm; and an eighth LED having an x-coordinate of about 15 mm, a y-coordinate of about −15 mm, and a z-coordinate of about 0 mm.

13. An LED signaling device, comprising:

a back plate;

a circuit board coupled to said back plate, said circuit board having a first surface with a number of LEDs arranged in a pattern thereon;

a reflector coupled to at least one of said back plate and said circuit board, said reflector having a number of reflective cavities each with an associated output angle, wherein at least some of said reflective cavities are arranged in said pattern and are structured to receive at least one of said LEDs therein;

a first lens coupled to at least one of said back plate, said circuit board, and said reflector, said first lens structured to disperse light rays emitted by at least some of said LEDs, said first lens being located a first distance from said first surface; and a second lens, coupled to at least one of said back plate, said circuit board, said reflector, and said first lens, said second lens structured to receive said light rays dispersed by said first lens and to collimate said light rays dispersed by said first lens, said second lens being located a second distance from said first surface;

wherein said pattern is arranged according to an x, y, z, coordinate system relative to a central axis of said LED signaling device and wherein said pattern includes:

a first LED having an x-coordinate of about 16 mm, a y-coordinate of about 8 mm, and a z-coordinate of about 0 mm, said first LED being received within a first one of said reflective cavities with an associated output angle of about 12 degrees;

a second LED having an x-coordinate of about −16 mm, a y-coordinate of about 8 mm, and a z-coordinate of about 0 mm, said second LED being received within a second one of said reflective cavities with an associated output angle of about 12 degrees;

a third LED having an x-coordinate of about 42 mm, a y-coordinate of about 7 mm, and a z-coordinate of about 0 mm, said third LED being received within a third one of said reflective cavities with an associated output angle of about 25 degrees;

a fourth LED having an x-coordinate of about −42 mm, a y-coordinate of about 7 mm, and a z-coordinate of about 0 mm, said fourth LED being received within a fourth one of said reflective cavities with an associated output angle of about 25 degrees;

a fifth LED having an x-coordinate of about 25 mm, a y-coordinate of about 30 mm, and a z-coordinate of about 0 mm, said fifth LED being received within a fifth one of said reflective cavities with an associated output angle of about 30 degrees;

a sixth LED having an x-coordinate of about −25 mm, a y-coordinate of about 30 mm, and a z-coordinate of about 0 mm, said sixth LED being received within a sixth one of said reflective cavities with an associated output angle of about 30 degrees;

a seventh LED having an x-coordinate of about 0 mm, a y-coordinate of about −30 mm, and a z-coordinate of about 0 mm, said seventh LED being received within a seventh one of said reflective cavities with an associated output angle of about 50 degrees; and an eighth LED having an x-coordinate of about 0 mm, a y-coordinate of about 30 mm, and a z-coordinate of about 0 mm, said eighth LED being received within an eighth one of said reflective cavities with an associated output angle of about 21 degrees.

14. An LED signaling device, comprising:

a back plate;

a circuit board coupled to said back plate, said circuit board having a first surface with a number of LEDs arranged in a pattern thereon;

a reflector coupled to at least one of said back plate and said circuit board, said reflector having a number of reflective cavities each with an associated output angle, wherein at least some of said reflective cavities are arranged in said pattern and are structured to receive at least one of said LEDs therein;

a first lens coupled to at least one of said back plate, said circuit board, and said reflector, said first lens structured to disperse light rays emitted by at least some of said LEDs, said first lens being located a first distance from said first surface; and a second lens, coupled to at least one of said back plate, said circuit board, said reflector, and said first lens, said second lens structured to receive said light rays dispersed by said first lens and to collimate said light rays dispersed by said first lens, said second lens being located a second distance from said first surface;

wherein said pattern is arranged according to an x, y, z, coordinate system relative to a central axis of said LED signaling device and wherein said pattern includes:

a first LED having an x-coordinate of about 16 mm, a y-coordinate of about 8 mm, and a z-coordinate of about 0 mm, said first LED being received within a first one of said reflective cavities with an associated output angle of about 12 degrees;

a second LED having an x-coordinate of about −16 mm, a y-coordinate of about 8 mm, and a z-coordinate of about 0 mm, said second LED being received within a second one of said reflective cavities with an associated output angle of about 12 degrees;

a third LED having an x-coordinate of about 42 mm, a y-coordinate of about 7 mm, and a z-coordinate of about 0 mm, said third LED being received within a third one of said reflective cavities with an associated output angle of about 25 degrees;

a fourth LED having an x-coordinate of about −42 mm, a y-coordinate of about 7 mm, and a z-coordinate of about 0 mm, said fourth LED being received within a fourth one of said reflective cavities with an associated output angle of about 25 degrees;

a fifth LED having an x-coordinate of about 25 mm, a y-coordinate of about 30 mm, and a z-coordinate of about 0 mm, said fifth LED being received within a fifth one of said reflective cavities with an associated output angle of about 30 degrees;

a sixth LED having an x-coordinate of about −25 mm, a y-coordinate of about 30 mm, and a z-coordinate of about 0 mm, said sixth LED being received within a sixth one of said reflective cavities with an associated output angle of about 30 degrees;

a seventh LED having an x-coordinate of about 0 mm, a y-coordinate of about −45 mm, and a z-coordinate of about 0 mm, said seventh LED being received within a seventh one of said reflective cavities with an associated output angle of about 50 degrees; and an eighth LED having an x-coordinate of about 0 mm, a y-coordinate of about 30 mm, and a z-coordinate of about 0 mm, said eighth LED being received within an eighth one of said reflective cavities with an associated output angle of about 21 degrees.

15. A method for providing an indication with an LED signaling device, comprising:

activating a number of LEDs to produce a plurality of light rays, wherein said LEDs are arranged in a pattern, and wherein each of at least some of said LEDs are associated with a respective one of a plurality of reflective cavities each having an associated output angle;

dispersing said light rays with a first lens;

collimating said light rays dispersed by said first lens with a second lens spaced from said first lens; and arranging said LEDs in said pattern, relative to a central axis of said LED signaling device according to an x, y, z coordinate system, by locating a first LED at an x-coordinate of about 16 mm, a y-coordinate of about 8 mm, and a z-coordinate of about 0 mm, a second LED at an x-coordinate of about −16 mm, a y-coordinate of about 8 mm, and a z-coordinate of about 0 mm, a third LED at an x-coordinate of about 42 mm, a y-coordinate of about 7 mm, and a z-coordinate of about 0 mm, a fourth LED at an x-coordinate of about −42 mm, a y-coordinate of about 7 mm, and a z-coordinate of about 0 mm, a fifth LED at an x-coordinate of about 25 mm, a y-coordinate of about 30 mm, and a z-coordinate of about 0 mm, a sixth LED at an x-coordinate of about −25 mm, a y-coordinate of about 30 mm, and a z-coordinate of about 0 mm, a seventh LED at an x-coordinate of about 30 mm, a y-coordinate of about −30 mm, and a z-coordinate of about 0 mm, and an eighth LED at an x-coordinate of about −30 mm, a y-coordinate of about −30 mm, and a z-coordinate of about 0 mm.

16. The method of claim 15 further comprising:

associating said first LED with a first reflective cavity having an output angle of about 12 degrees, said second LED with a second reflective cavity having an output angle of about 12 degrees, said third LED with a third reflective cavity having an output angle of about 15.5 degrees, said fourth LED with a fourth reflective cavity having an output angle of about 15.5 degrees, said fifth LED with a fifth reflective cavity having an output angle of about 30 degrees, said sixth LED with a sixth reflective cavity having an output angle of about 30 degrees, said seventh LED with a seventh reflective cavity having an output angle of about 50 degrees, and said eighth LED with an eighth reflective cavity having an output angle of about 50 degrees.

17. The method of claim 15 wherein said dispersing further comprises dispersing said light rays with a first fresnel lens.

18. The method of claim 17 wherein said collimating further comprises collimating said light rays dispersed by said first fresnel lens with a second fresnel lens.

19. A method for providing an indication with an LED signaling device, comprising:

activating a number of LEDs to produce a plurality of light rays, wherein said LEDs are arranged in a pattern, and wherein each of at least some of said LEDs are associated with a respective one of a plurality of reflective cavities each having an associated output angle;

dispersing said light rays with a first lens;

collimating said light rays dispersed by said first lens with a second lens spaced from said first lens; and arranging said LEDs in said pattern, relative to a central axis of said LED signaling device according to an x, y, z coordinate system, by locating a first LED at an x-coordinate of about 18 mm, a y-coordinate of about 10 mm, and a z-coordinate of about 0 mm, a second LED at an x-coordinate of about −18 mm, a y-coordinate of about 10 mm, and a z-coordinate of about 0 mm, a third LED at an x-coordinate of about 46 mm, a y-coordinate of about 10 mm, and a z-coordinate of about 0 mm, a fourth LED at an x-coordinate of about −46 mm, a y-coordinate of about 10 mm, and a z-coordinate of about 0 mm, a fifth LED at an x-coordinate of about 0 mm, a y-coordinate of about 24 mm, and a z-coordinate of about 0 mm, a sixth LED at an x-coordinate of about 0 mm, a y-coordinate of about 38 mm, and a z-coordinate of about 0 mm; a seventh LED at an x-coordinate of about −30 mm, a y-coordinate of about −30 mm, a z-coordinate of about 0 mm, and an eighth LED at an x-coordinate of about 30 mm, a y-coordinate of about −30 mm, and a z-coordinate of about 0 mm.

20. The method of claim 19 further comprising:

associating said first LED with a reflective cavity having an output angle of about −10 degrees, said second LED with a reflective cavity having an output angle of about −10 degrees; said third LED with a reflective cavity having an output angle of about −5 degrees; said fourth LED with a reflective cavity having an output angle of about −5 degrees, and said fifth LED with a reflective cavity having an output angle of about −10 degrees.

21. A method for providing an indication with an LED signaling device, comprising:

activating a number of LEDs to produce a plurality of light rays, wherein said LEDs are arranged in a pattern, and wherein each of at least some of said LEDs are associated with a respective one of a plurality of reflective cavities each having an associated output angle;

dispersing said light rays with a first lens;

collimating said light rays dispersed by said first lens with a second lens spaced from said first lens; and arranging said LEDs in said pattern, relative to a central axis of said LED signaling device according to an x, y, z coordinate system, by locating a first LED at an x-coordinate of about 16 mm, a y-coordinate of about 8 mm, and a z-coordinate of about 0 mm, a second LED at an x-coordinate of about −16 mm, a y-coordinate of about 8 mm, and a z-coordinate of about 0 mm, a third LED at an x-coordinate of about 42 mm, a y-coordinate of about 7 mm, and a z-coordinate of about 0 mm, a fourth LED at an x-coordinate of about −42 mm, a y-coordinate of about 7 mm, and a z-coordinate of about 0 mm, a fifth LED at an x-coordinate of about 25 mm, a y-coordinate of about 30 mm, and a z-coordinate of about 0 mm, a sixth LED at an x-coordinate of about -25 mm, a y-coordinate of about 30 mm, and a z-coordinate of about 0 mm, a seventh LED at an x-coordinate of about 0 mm, a y-coordinate of about -30 mm, and a z-coordinate of about 0 mm, and an eighth LED at an x-coordinate of about 0 mm, a y-coordinate of about 30 mm, and a z-coordinate of about 0 mm.

22. The method of claim 21 further comprising:

associating said first LED with a first reflective cavity having an output angle of about 12 degrees, said second LED with a second reflective cavity having an output angle of about 12 degrees, said third LED with a third reflective cavity having an output angle of about 25 degrees, said fourth LED with a fourth reflective cavity having an output angle of about 25 degrees, said fifth LED with a fifth reflective cavity having an output angle of about 30 degrees, said sixth LED with a sixth reflective cavity having an output angle of about 30 degrees, said seventh LED with a seventh reflective cavity having an output angle of about 50 degrees, and said eighth LED with an eighth reflective cavity having an output angle of about 21 degrees.

23. A method for providing an indication with an LED signaling device, comprising:

activating a number of LEDs to produce a plurality of light rays, wherein said LEDs are arranged in a pattern, and wherein each of at least some of said LEDs are associated with a respective one of a plurality of reflective cavities each having an associated output angle;

dispersing said light rays with a first lens;

collimating said light rays dispersed by said first lens with a second lens spaced from said first lens; and arranging said LEDs in said pattern, relative to a central axis of said LED signaling device according to an x, y, z coordinate system, by locating a first LED at an x-coordinate of about 16 mm, a y-coordinate of about 8 mm, and a z-coordinate of about 0 mm, a second LED at an x-coordinate of about −16 mm, a y-coordinate of about 8 mm, and a z-coordinate of about 0 mm, a third LED at an x-coordinate of about 42 mm, a y-coordinate of about 7 mm, and a z-coordinate of about 0 mm, a fourth LED at an x-coordinate of about −42 mm, a y-coordinate of about 7 mm, and a z-coordinate of about 0 mm, a fifth LED at an x-coordinate of about 25 mm, a y-coordinate of about 30 mm, and a z-coordinate of about 0 mm, a sixth LED at an x-coordinate of about −25 mm, a y-coordinate of about 30 mm, and a z-coordinate of about 0 mm, a seventh LED at an x-coordinate of about 0 mm, a y-coordinate of about −45 mm, and a z-coordinate of about 0 mm, and an eighth LED at an x-coordinate of about 0 mm, a y-coordinate of about 30 mm, and a z-coordinate of about 0 mm.

24. The method of claim 23 further comprising:

associating said first LED with a first reflective cavity having an output angle of about 12 degrees, said second LED with a second reflective cavity having an output angle of about 12 degrees, said third LED with a third reflective cavity having an output angle of about 25 degrees, said fourth LED with a fourth reflective cavity having an output angle of about 25 degrees, said fifth LED with a fifth reflective cavity having an output angle of about 30 degrees, said sixth LED with a sixth reflective cavity having an output angle of about 30 degrees, said seventh LED with a seventh reflective cavity having an output angle of about 50 degrees, and said eighth LED with an eighth reflective cavity having an output angle of about 21 degrees.

* * * * *